US006238172B1

(12) United States Patent
Onishi

(10) Patent No.: US 6,238,172 B1
(45) Date of Patent: May 29, 2001

(54) EMPTY CASE CENTERING DEVICE FOR A DISK PACKAGING APPARATUS

(75) Inventor: Toshiyuki Onishi, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/384,492

(22) Filed: Aug. 27, 1999

(30) Foreign Application Priority Data

May 14, 1999 (JP) ..... 11-133896

(51) Int. Cl.[7] ..... B65B 25/24; B65B 35/00; B65B 43/00

(52) U.S. Cl. ..... 414/754; 414/737; 53/254; 360/99.06; 369/75.2

(58) Field of Search ..... 414/754, 782, 414/783, 737; 53/254, 445, 467, 468; 369/271, 75.2, 77.2; 360/99.06; 206/310, 312

(56) References Cited

U.S. PATENT DOCUMENTS 4,852,327 * 8/1989 Kurkowski et al. ..... 53/201
5,142,523 * 8/1992 Kamoshita ..... 369/75.2
5,341,624 * 8/1994 Kaye ..... 53/254
5,586,651 * 12/1996 Krummenacher ..... 206/310
5,664,405 * 9/1997 Perego ..... 53/457
5,816,028 * 10/1998 Zaniboni ..... 53/445
6,048,158 * 4/2000 Zaniboni ..... 414/737 X

FOREIGN PATENT DOCUMENTS 41 15 389 * 11/1992 (DE) ..... 414/754

* cited by examiner

*Primary Examiner*—Robert P. Olszewski
*Assistant Examiner*—Gerald J. O'Connor
(74) *Attorney, Agent, or Firm*—W. F. Fasse; W. G. Fasse

(57) ABSTRACT

An apparatus for positioning a case to be loaded with an optical disk, includes a pair of slide plates slidable in opposite, horizontal directions for moving a pair of positioning members (5A, 5B) rotatably connected to the ends of the slide plates. The positioning members are moved between a withdrawn rest position in which toe faces (6*a*) of the positioning members (5A, 5B) do not contact the case, and a locating position wherein the toe faces contact an outer circumference of a ridge of the case to precisely locate the case. The positioning members (5A, 5B) are driven between the withdrawn position and the locating position by a cam drive including a cam and a cam follower cooperating with each positioning member. The cam follower moves along the inclined surface of the cam provided at the case locating station.

7 Claims, 7 Drawing Sheets

EMPTY CASE CENTERING DEVICE FOR A DISK PACKAGING APPARATUS

FIELD OF THE INVENTION

The present invention relates to an apparatus for positioning a plastic case into which an information storing disk, hereinafter called an "optical disk", such as a CD (i.e. compact disk), DVD (i.e. digital video disk) or the like is loaded.

BACKGROUND INFORMATION

Generally, a case used for an optical disk has a foldable, rectangular box-shape. A round, recessed portion for receiving an optical disk is provided on one side of the case. A push button is formed on the center of the recessed portion of the case. On the other side of the case there is a claw-shaped, holding member for holding a description sheet etc. with visual information on the contents of the optical disk.

When loading an optical disk into such a conventional case, it is necessary for the push button of the case to be inserted into the central hole of the optical disk. Therefore, before loading the optical disk into the case, the case must be positioned, as precisely as possible, relative to the optical disk to be loaded. Conventionally, positioning of the case is carried out by positioning the outer circumference of the case.

However, the dimensional accuracy of the outer circumference of a case is not such that the push button is precisely positioned, when the case is positioned using the outer circumference of the case. A not precisely positioned push button of the case cannot be inserted properly into the central hole of the optical disk at the time of loading of the optical disk into the case. As a result, the optical disk cannot be securely loaded into the case.

The present invention is directed to solving the above-described problem in the conventional case positioning method, and offers an apparatus for positioning a case that can accurately and securely load an optical disk into a case.

SUMMARY OF THE INVENTION

In the present invention, the inventor has discovered that the ridge surrounding a recess in a case for receiving an optical disk, is more accurate in its dimensions than the outer circumference of the case. By utilizing the ridge that surrounds the disk receiving recess in the case, the optical disk can be precisely and securely loaded into the case.

In a first embodiment of the present invention, a device or mechanism for positioning a case is constructed for accurately positioning or locating a case relative to an optical disk prior to loading the optical disk into the case. The case includes a ridge portion which surrounds a round, recess in the case for receiving an optical disk. The apparatus for positioning a case includes at least one positioning device or mechanism that contacts the outer circumference of the recess surrounding ridge.

In a second embodiment of the present invention, a case positioning device or mechanism is adapted to take a withdrawn or recessed position where the positioning device withdraws or recedes from the case placed at a case positioning station, and from the locating position of the positioning device where the positioning device comes in contact with the outer circumference of the recess surrounding ridge of the case.

In a third embodiment, the positioning device comprises a pair of positioning members placed apart and facing each other wherein each of the positioning members is adapted to take up the withdrawn position or the locating position.

A fourth embodiment further comprises a pair of slide plates movable in opposite, horizontal directions. Each positioning member is rotatably connected to each end portion of the slide plates. A cam follower is provided at each positioning member and a cam corresponding to each cam follower is provided at the case positioning station. When the slide plates move, each cam follower moves along an inclined surface of the corresponding cam, whereby each positioning member is moved between the withdrawn position and the locating position.

As described above, a preferred embodiment of the present invention utilizes the recess surrounding ridge of a case, which is more accurate in its dimensions which surround a round recess for receiving an optical disk. The case is positioned in place by the case positioning device or mechanism coming in contact with the outer circumference of the ridge of the recess in the case. Thus, the recess in the case can be precisely positioned in relation to the optical disk to be loaded into the recess of the case. Thereby, the optical disk can be accurately and securely loaded into the case.

In another embodiment of the present invention, as each slide plate of a pair of slide plates slides in an opposite, horizontal direction and each positioning member corresponding to each slide plate moves in the same direction for taking the withdrawn position or the locating position in response to the action of a cam and cam follower as described above.

When each of the slide plates moves in the separating direction, each positioning member moves with the corresponding slide plate. At this time, each cam follower moving along with each positioning member moves along the inclined surface of a cam provided at the case positioning station. Thereby, each cam follower, and thus each positioning member rotates upwardly. As a result, each positioning member moves into the withdrawn position.

When each of the slide plates moves in the approaching direction, each positioning member moves with the corresponding slide plate. At this time, each cam follower moving along with each positioning member moves along the inclined surface of a cam at the case positioning station. Thereby, each cam follower, and thus each positioning member rotates downwardly and into the locating position, where the positioning members come in contact with the outer circumference of the recess surrounding ridge of a case. Thus, the case is positioned centered relative to the optical disk to be loaded. In such a way, a case positioning apparatus that can accurately and securely load an optical disk into a case has been realized with a simple construction.

BRIEF DESCRIPTION OF THE DRAWINGS

For a more complete understanding of the invention, reference is made to the embodiments illustrated in greater detail in the accompanying drawings which are not to scale, and wherein.

DETAILED DESCRIPTION OF PREFERRED EXAMPLE EMBODIMENTS AND OF THE BEST MODE OF THE INVENTION

Figure 1:
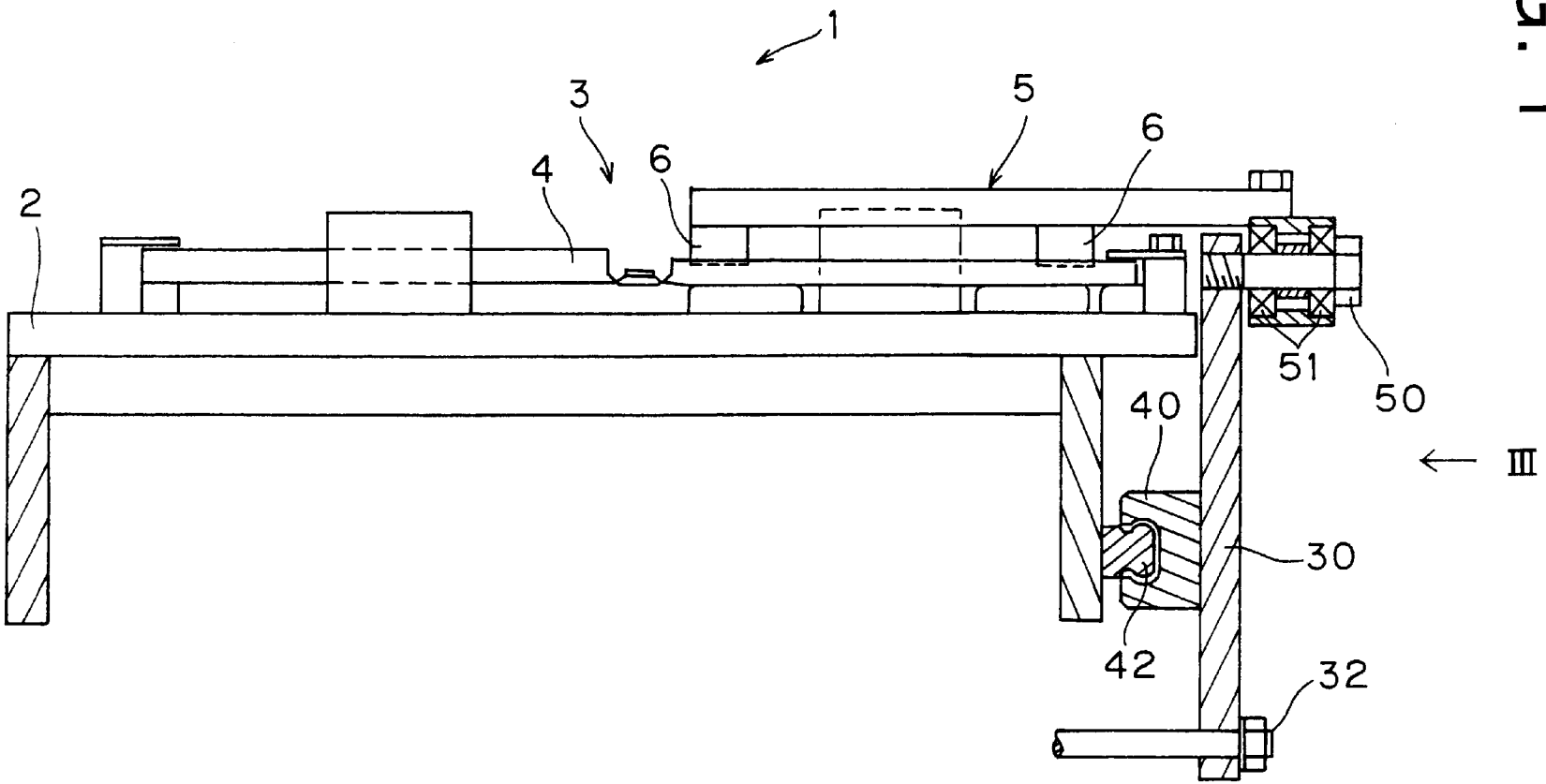
FIG. 1 is a side view partially in section along section plane I—I in FIG. 3 of a case positioning apparatus according to a preferred embodiment of the present invention.
Figure 2:
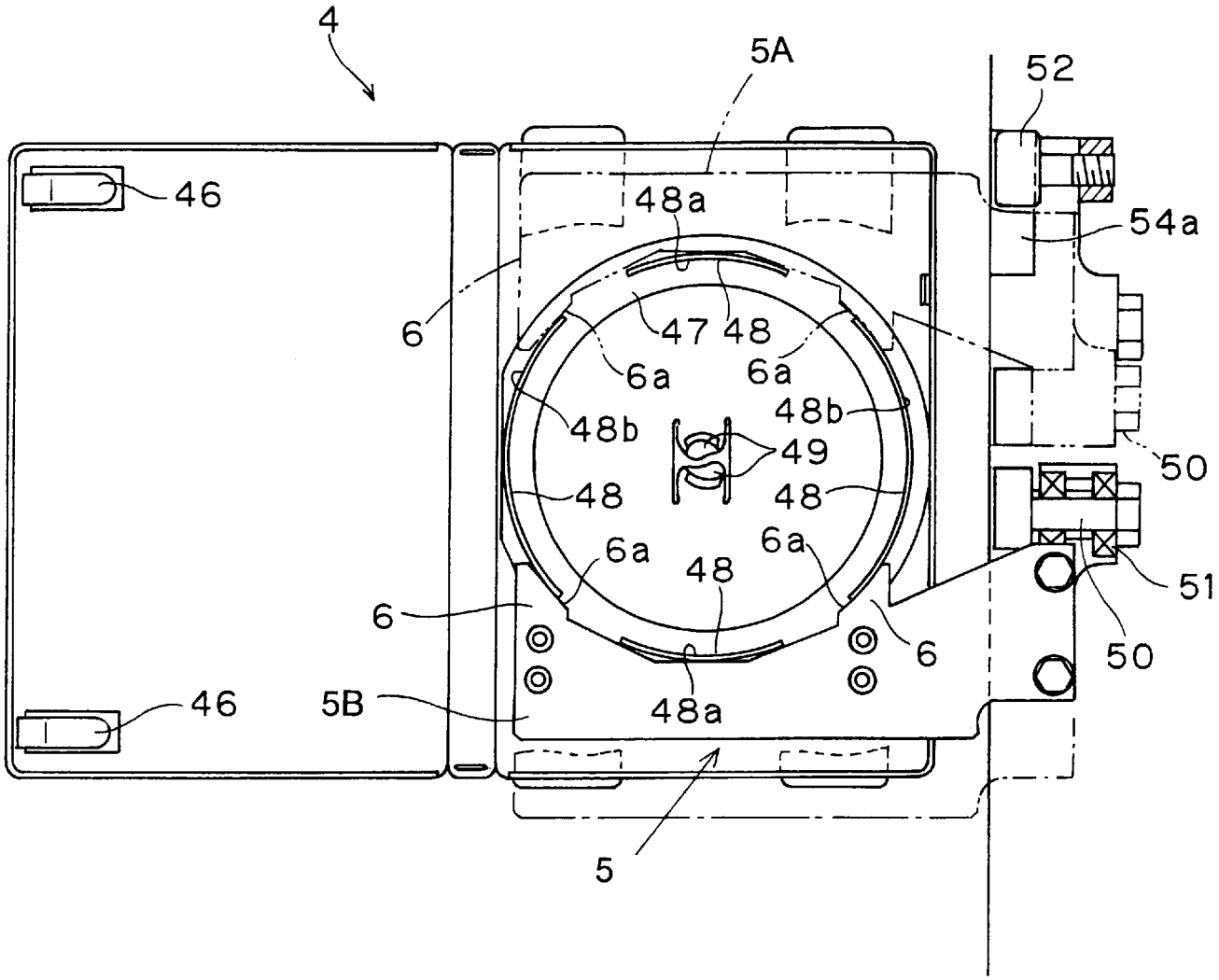
FIG. 2 is a top plan view of the case positioning apparatus of FIG. 1.
Figure 3:
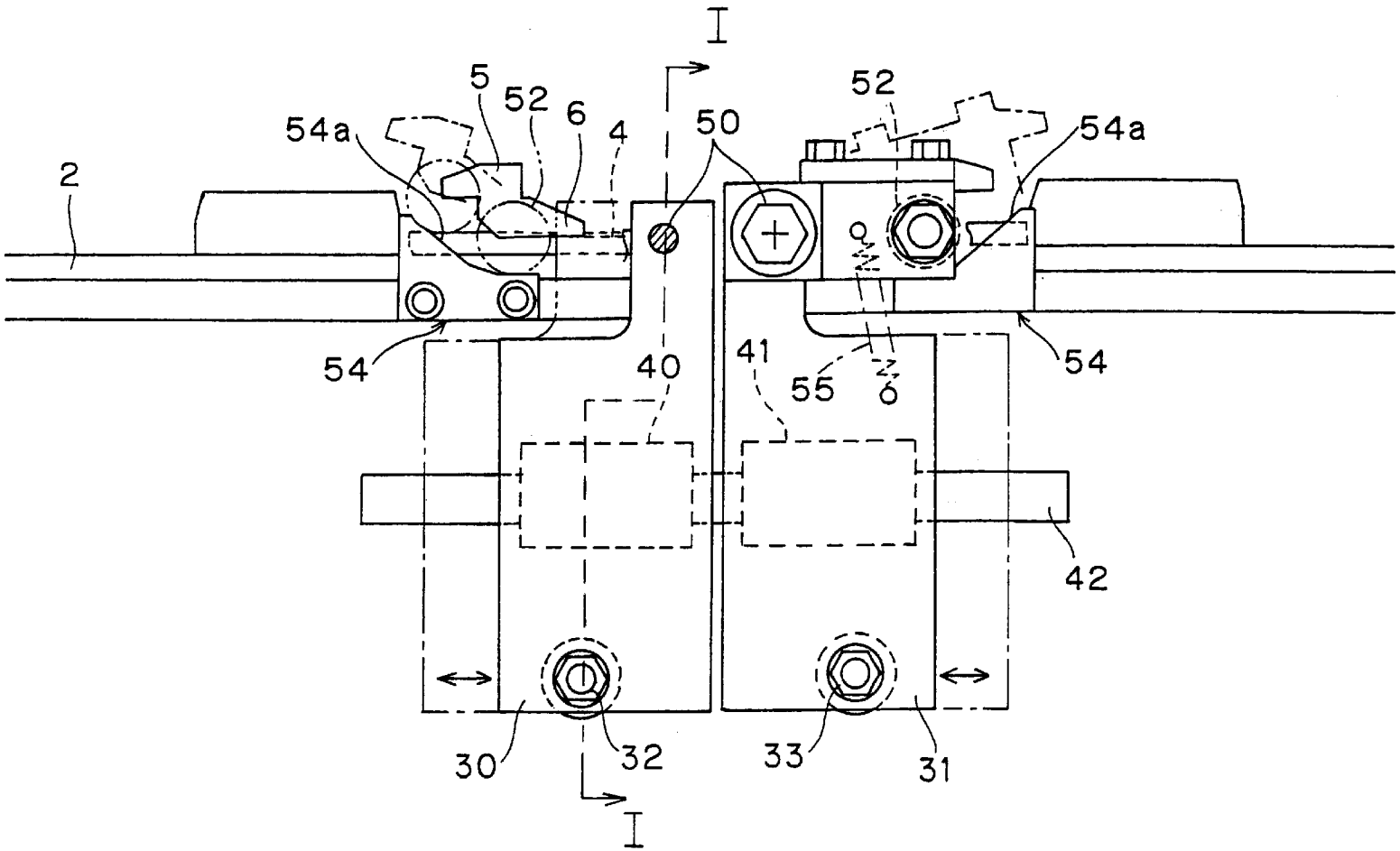
FIG. 3 is a front elevational view of the case positioning apparatus, as viewed in the direction of the arrows III—III in FIG. 1.

Referring now the drawings, FIGS. 1 to 3 illustrate an apparatus for positioning a case in a disk packaging apparatus. An optical or compact disk is to be loaded into the case. As shown in FIG. 1, the case positioning apparatus 1 includes a positioning device 5 to position a case 4 placed at the position station 3 over the base 2. The positioning device 5, as shown in FIG. 2, comprises a pair of locating or case positioning members 5A, 5B placed apart and facing each other. Each locating member 5A, 5B has a pair of toes 6. In FIG. 2, one of the members 5A is shown in a double dotted line for illustration purposes. The locating members position the case 4 by contacting ridges 48 of the case 4 as will be described in more detail below. The locating members are also referred to as ridge contacting members.

As shown in FIG. 3, a pair of slide plates 30, 31 extending in the vertical direction are provided to drive each of the positioning members 5A, 5B. Linear guides 40, 41 are respectively fixed at the back of the slide plates 30, 31 and the linear guides 40, 41 are slidable along the rail 42 positioned under the base 2.

Bolts 32, 33 are inserted into the lower ends of the slide plates 30, 31 and the bolts 32, 33 are adapted to be driven equally in the transverse direction of FIG. 3 by a driving mechanism including a cam, lever or the like.

A bolt 50 is provided at the upper end of each of the slide plates 30, 31 and each bolt 50 is connected to a member of the positioning device 5 through a bearing member 51. Thereby, each positioning member 5A, 5B is rotatable around the axis of the bolt 50. Each positioning or locating member 5A, 5B takes up the locating position where the toes 6 of the positioning device 5 contact the case 4 and locate it, as shown by a solid line and by a double dotted line in FIG. 2 and by a solid line in FIG. 3, and the withdrawn position where the toes 6 of the positioning device 5 are withdrawn from the case 4, as shown by one dotted line in FIGS. 2 and 3.

A cam follower 52 seen in FIGS. 2 and 3 is provided on each positioning member 5A, 5B. Cams 54 each corresponding to one of the cam followers 52 are also mounted on the base 2. An inclined surface 54*a* sloping downwardly in the facing direction relative to the other cam 54 is formed on each of the cams 54. In addition, a pair of springs 55 is provided beside the slide plates 30, 31. In FIG. 3, only the spring 55 beside the slide plate 31 is shown. One end of the spring 55 is connected to the respective positioning or ridge contact member 5A, 5B and the other end of it is connected to the slide plate 31. By the forces of the springs 55, at the time of sliding movement of the slide plates 30, 31, each cam follower 52 moves along an inclined surface 54*a* of the corresponding cam 54. The cam followers contact the inclined surface 54*a* of the cam 54 at a predetermined pressure as exerted by the springs 55, whereby the springs 55 tend to bias the ridge contact members 5A, 5B into a ridge contacting position.

Figure 4:
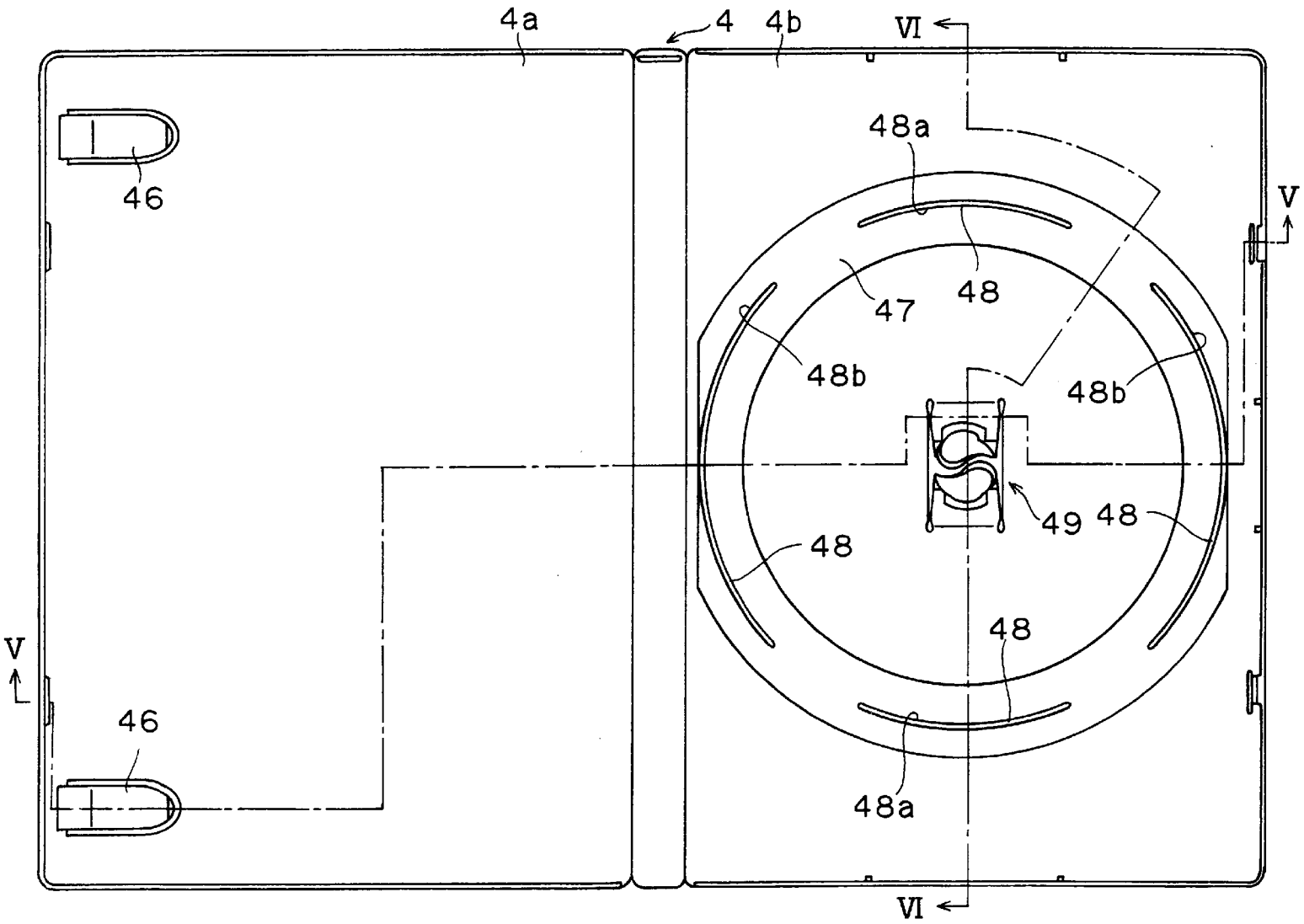
FIG. 4 is a top plan developed view of a case.
Figure 5:
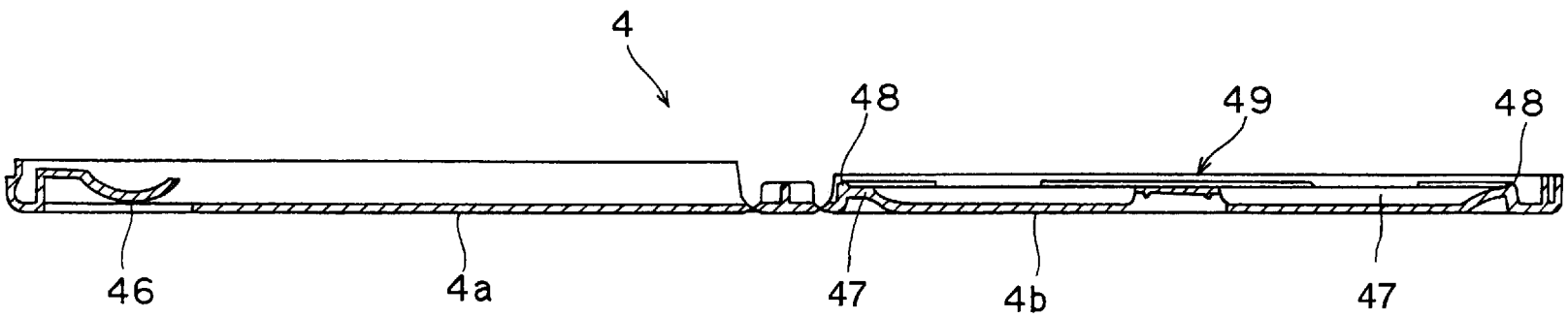
FIG. 5 is a cross-sectional view of the case taken along line V—V in FIG. 4.
Figure 6:
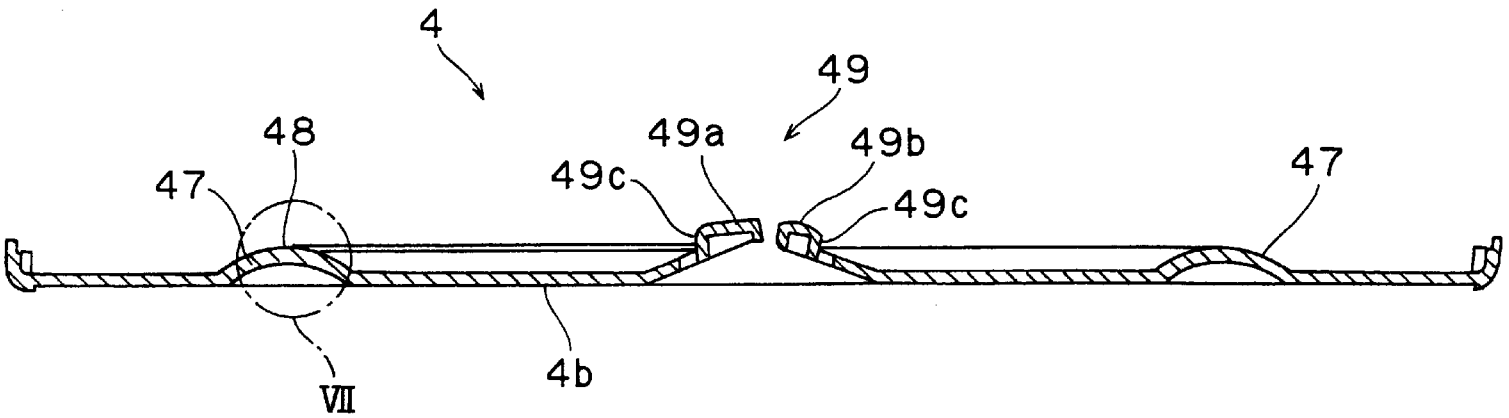
FIG. 6 is a cross-sectional view taken along line VI—VI in FIG. 4.

FIGS. 4 to 7 illustrate a case 4 used for an optical disk. As shown in FIGS. 4 and 5, the case 4 has a foldable, box-shaped form and a pair of holding claws 46 are provided on one case section 4*a* of the case 4 to hold a description sheet or the like with visual information on the optical disk.

Figure 7:
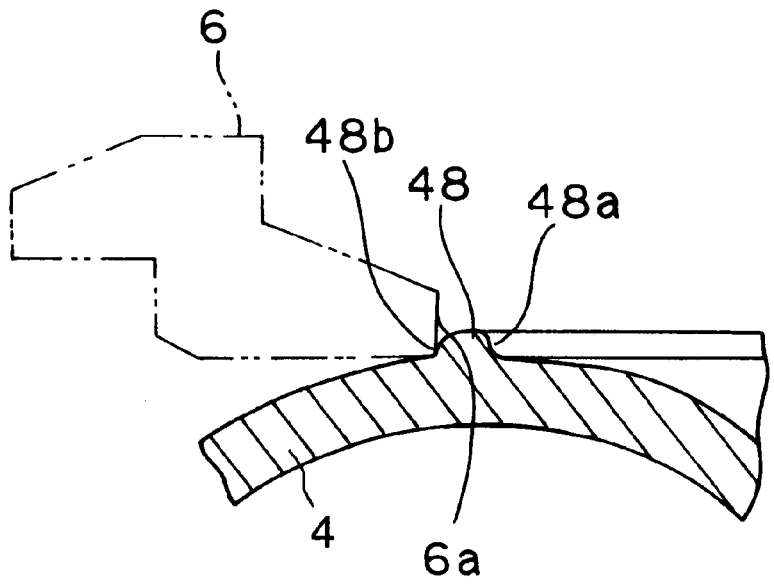
FIG. 7 is an enlarged view of a portion VII of FIG. 6.

The other case section 4*b* of the case 4 comprises a circumferentially extending ring surface 47 having an arc-shaped cross-section. A plurality of arcuately extending ridges 48 are formed on top of the ring surface 47. The inner circumference 48*a* of the ridges 48 and the top of the ring surface 47 form a circular recess for receiving an optical disk. At the time of positioning or locating a case 4 by the positioning device 5, the faces 6*a* of each toe 6 of the locating members 5A, 5B contact the outer circumference 48*b* of each ridge 48, as shown in FIG. 7. Thus, the locating members 5A, 5B function as ridge contact members.

A push button 49 is provided at the center of the case bottom 4*b*. As clearly shown in FIG. 6, the push button 49 comprises a pair of button sections 49*a*, 49*b* each having a resilience in the vertical direction. When loading an optical disk into the case 4, the outer circumference 49*c* of each of the button sections 49*a*, 49*b* engages with a central hole of the optical disk.

Next, the case positioning method according to the preferred embodiment of the present invention will be described in detail below. Before the case 4 is placed in the positioning station 3, each of the slide plates 30, 31 is moved in the separating outward direction into a dotted line position shown in FIG. 3.

At this time, each cam follower 52 moves upwardly along the inclined surface 54*a* of the corresponding cam 54, whereby each positioning member 5A, 5B rotates upwardly around the axis of the bolt 50 and is placed in the withdrawn position shown by a dash-dotted line in FIG. 3.

When the case 4 has been placed in the position station 3, the slide plates 30, 31 slide in the approaching inward direction to move into the solid line position shown in FIG. 3.

When the slide plates 30, 31 slide downwardly each cam follower 52 of the positioning device 5 moves downwardly along the inclined surface 54*a* of the corresponding cam 54. Thereby, the position member 5 rotates downwardly around the axis of the bolt 50 and moves to the locating position shown in a solid line of FIG. 3. Then, the face 6*a* of each toe 6 of the positioning device 5 contacts the outer circumference 48*b* of the respective ridge 48 of the case 4, as shown in FIGS. 2 and 7, whereby the locating of the case 4 is completed.

According to the preferred embodiment of the present invention the case positioning or locating is accomplished by contacting the outer circumference 48*b* of the ridges 48 by the toe faces 6*a*, whereby the recess surrounded by the ridges 48 is precisely positioned or located for receiving the optical disk to be loaded. Thus, the optical disk can be accurately and securely loaded into the recess of the case. Furthermore, in this embodiment, the case positioning apparatus 1 is basically constructed by a pair of positioning members 5A, 5B, cam followers 52 and cams 54, whereby a simple structure is achieved.

Those skilled in the art to which the invention pertains may make modifications and other embodiments employing the principles of this invention without departing from its spirit or essential characteristics particularly upon considering the foregoing teachings. The described embodiments and examples are illustrative and not restrictive. The scope of the invention is indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. An empty case centering device for a disk packaging machine for loading a disk into said empty case, said case having at least one ridge positioned radially outwardly in said case and surrounding at least partly a recess in said case for receiving a disk in said recess, said centering device comprising a positioning mechanism (5) for locating said case in said disk packaging machine, said positioning a mechanism (5) comprising ridge contact members (5A, 5B) for contacting said at least one ridge radially outwardly of said at least one ridge to thereby locate said empty case, and a drive for moving said ridge contact members (5A, 5B) inwardly into a ridge contacting position and outwardly into a withdrawn position.

2. The device of claim 1, wherein said drive comprises a cam (54) and cam follower (52) for moving said ridge contact members (5A, 5B) back and forth between said ridge contacting position and said withdrawn position.

3. The device of claim 2, further comprising a base (2), and wherein said drive further comprises a pair of slide plates (30, 31) movably mounted to said base (2) and operatively connected to said ridge contact members (5A, 5B), and wherein said slide plates drive said cam (54) and said cam follower (52) for moving said ridge contact members (5A, 5B) back and forth between said ridge contacting position and said withdrawn position.

4. The device of claim 3, further comprising a biasing spring (55) operatively connected to a respective slide plate of said pair of slide plates and to a respective ridge contact member (5A, 5B) for pressing said cam follower connected to a respective slide plate of said pair of slide plates, against said cam (54) and for biasing said ridge contact members (5A, 5B) into said ridge contacting position, to keep said empty case centered for placing a disk into said recess.

5. The device of claim 1, wherein said at least one ridge comprises a plurality of ridge sections forming circular arcs circumferentially spaced around said recess in said case, and wherein each of said ridge contact members (5A, 5B) comprises a number of toes **(6*a*)**, each toe having a radially inwardly facing surface for contacting a radially outwardly facing surface of said circular arcs.

6. The device of claim 5, wherein said inwardly facing surface of said toes **(6*a*)** is shaped as a circular curve matching said circular arcs.

7. The device of claim 1, wherein said ridge contact members (5A, 5B) are arranged in pairs, said pairs of ridge contact members facing across said recess in said case.

* * * * *